US005437387A

United States Patent [19]

Burns

[11] Patent Number: 5,437,387

[45] Date of Patent: Aug. 1, 1995

[54] CONTAINER WITH SCREW-ON CAP HAVING A CONTROLLED-TORQUE LATCH

[75] Inventor: James A. Burns, Lake Elmo, Minn.

[73] Assignee: Minnesota Mining and Manufacturing Company, St. Paul, Minn.

[21] Appl. No.: 4,946

[22] Filed: Jan. 15, 1993

[51] Int. Cl.[6] ..... B65D 45/16

[52] U.S. Cl. ..... 220/326; 220/324; 220/281; 220/288; 215/213; 215/216; 215/221; 215/356

[58] Field of Search ..... 215/213, 214, 216, 221, 215/356; 220/324, 326, 281, 288

[56] References Cited

U.S. PATENT DOCUMENTS

| | | | |
|---|---|---|---|
| 3,365,088 | 1/1968 | Turner | 215/9 |
| 3,376,992 | 4/1968 | Klapp, Sr. | 215/221 |
| 3,447,709 | 6/1969 | Marasco | 215/221 |
| 3,582,535 | 6/1971 | Appleton | 220/288 X |
| 3,743,127 | 7/1973 | Morceau | 215/221 |
| 3,935,963 | 2/1976 | Knize | 215/221 X |
| 4,037,747 | 7/1977 | Acton et al. | 215/219 |
| 4,103,797 | 8/1978 | Morris | 215/209 |
| 4,207,982 | 6/1980 | Maxwell et al. | 215/230 X |
| 4,331,247 | 5/1982 | Mumford | 215/216 |
| 4,690,292 | 9/1987 | Henning | 215/201 |
| 4,732,288 | 3/1988 | Morris, Sr. | 215/214 |
| 4,752,014 | 6/1988 | House et al. | 215/216 |
| 4,967,926 | 11/1990 | Morris, Sr. | 220/323 |
| 5,024,865 | 6/1991 | Insley | 428/36.4 |
| 5,029,699 | 7/1991 | Insley et al. | 206/204 |
| 5,096,083 | 3/1992 | Shaw et al. | 220/304 |
| 5,125,538 | 6/1992 | Morris, Sr. | 215/329 X |

*Primary Examiner*—Gary E. Elkins
*Assistant Examiner*—Vanessa Caretto
*Attorney, Agent, or Firm*—Gary L. Griswold; Walter N. Kirn; Carole Truesdale

[57] ABSTRACT

A container for transporting and storing vessels containing hazardous liquids and a method for making such a container. The container has a cylindrical housing and a cap that screws into the mouth of the housing and is locked by a latch. When the cap is screwed into place, an elastomeric sealing ring on the cap is compressed against the housing to provide a liquid-tight seal between the housing and cap. Interlocking hook-shaped members that project from the housing and from a central location of the latch act as a fulcrum on which the latch can be pivoted. Under the bias of a serpentine tongue, a locking member that projects from an end of the latch protrudes through a bore in the housing and is adapted to be received by a hole in the cap, thus locking the cap until the other end of the lever is depressed to disengage the locking member from the hole of the cap. The hole in the cap is drilled at a position such that the locking member fits into the hole when the cap has been sufficiently screwed into the housing to provide a liquid-tight seal between the cap and housing, yet not so tight as to damage the threaded portions or make it unduly difficult to unscrew the cap.

12 Claims, 5 Drawing Sheets

CONTAINER WITH SCREW-ON CAP HAVING A CONTROLLED-TORQUE LATCH

FIELD OF THE INVENTION

The invention relates to containers that have liquid-tight caps and primarily concerns containers that are useful for shipping and storing vessels containing hazardous materials.

DESCRIPTION OF THE RELATED ART

Coassigned U.S. Pat. No. 5,029,699 (Insley et al.) discloses a container which is useful for transporting and storing vessels containing hazardous liquids. The container has a self-sustaining housing filled with a first sorbent body comprising a pocket that snugly receives a vessel holding hazardous materials. The container includes a lid comprising a second sorbent body that typically bears against the vessel and holds it snugly in place when the lid is secured on the housing. The housing and lid preferably comprise a high-impact thermoplastic resin such as polyethylene which is economical, easily molded, and has excellent chemical resistance. The container shown in FIG. 3 of the patent includes a ratcheting cap to ensure correct tightness of the lid and an elastomeric O-ring to ensure a liquid-tight seal.

U.S. Pat. No. 5,096,083 (Shaw et al.) discloses a polyethylene shipping drum especially suited for shipping hazardous materials. The drum comprises a molded container and closure which are adapted to be threadably connected to form a seal therebetween. A thread lock is provided for the threaded connection between the container and closure. Three locking positions are provided wherein the closure is locked against unthreading. The thread lock is disengaged by distorting the container and closure in opposite directions adjacent the thread lock. Thus, at least one of the container and closure is sufficiently resilient to permit disengagement of the thread lock.

SUMMARY OF THE INVENTION

The present invention relates to an easy-to-use container typically used for shipping and storing vessels containing hazardous wastes. Each time the cap of the container is closed on the housing of the container, the cap can be properly tightened to the appropriate torque and not over-tightened. Once the cap is locked onto the housing, the cap cannot be further threaded or unthreaded without unlocking the cap from the housing. These features are important because insufficient tightening of a container cap typically leads to a leaky container, and overtightening of the cap can make it much more difficult for the next user of the container to remove the cap. Additionally, overtightening of the cap can damage or twist the elastomeric sealing ring on the cap, thereby resulting in a poor seal between the cap and the housing or impairing the sealing ring's effectiveness in subsequent uses of the container. An additional advantage of a container of the invention is that a "clicking" sound is typically made when a predetermined, desirable amount of torque has been applied to the cap in securing the cap to the housing. Furthermore, neither the housing nor the cap needs to be made of a resilient material since neither needs to be distorted in order to unlock the cap from the housing.

In brief summary, the container comprises:

a) a housing;

b) a removable cap;

c) a first wall on one of the housing and cap, the first wall comprising a first threaded portion;

d) a second wall on the other of the housing and cap, the second wall comprising a second threaded portion that is adapted to mate with the first threaded portion;

e) a catch formed on the second wall;

f) a bore formed through the first wall; and g) a manually releasable, self-activating latch mounted on the first wall, the latch comprising an elongated lever, the lever comprising a locking member which is adapted to protrude through the bore and slide along the second wall when the first and second threaded portions are being threadably secured together, wherein the latch and the catch are positioned on their respective walls such that the locking member is adapted to engage the catch to prevent relative movement between the first and second threaded portions only when a predetermined torque is applied to the first and second threaded portions.

Typically, the housing comprises a substantially cylindrical base and a collar comprising one of the first and second walls. Further, the housing can comprise the first wall and the cap can comprise the second wall. Alternatively, the cap can compromise the first wall and the housing can compromise the second wall. Also, the catch typically is a hole into which the locking member can fit.

Generally, if the container further comprises an elastomeric sealing ring, the cap can be sufficiently tightened on the housing to provide a liquid-tight seal between the cap and the housing to prevent the leakage of hazardous materials out of the container.

In another of its aspects, the invention relates to a method for making a container, wherein a housing and removable cap are provided, the housing comprising a first wall which has a first threaded portion, the removable cap comprising a second wall which has a second threaded portion that is adapted to mate with the first threaded portion. Next, the cap is secured on the housing by threadably securing the first and second threaded portions until a predetermined torque is achieved. While maintaining the predetermined torque, a hole is formed in the second wall so that the hole is in register with a bore in the first wall. The bore can be formed substantially simultaneously as the hole or the bore and hole can be formed in separate steps. A self-activating latch is then mounted on the first wall. The latch comprises a locking member which is adapted to protrude through the bore and slide along the second wall when the first and second threaded portions are being threadably secured together and engage the hole to prevent relative movement between the first and second threaded portions only when the predetermined torque is achieved.

BRIEF DESCRIPTION OF THE DRAWINGS

The invention may be more easily understood in reference to the drawing, both figures of which are schematic. In the drawing.

DETAILED DESCRIPTION OF ILLUSTRATIVE EMBODIMENTS

Figure 1:
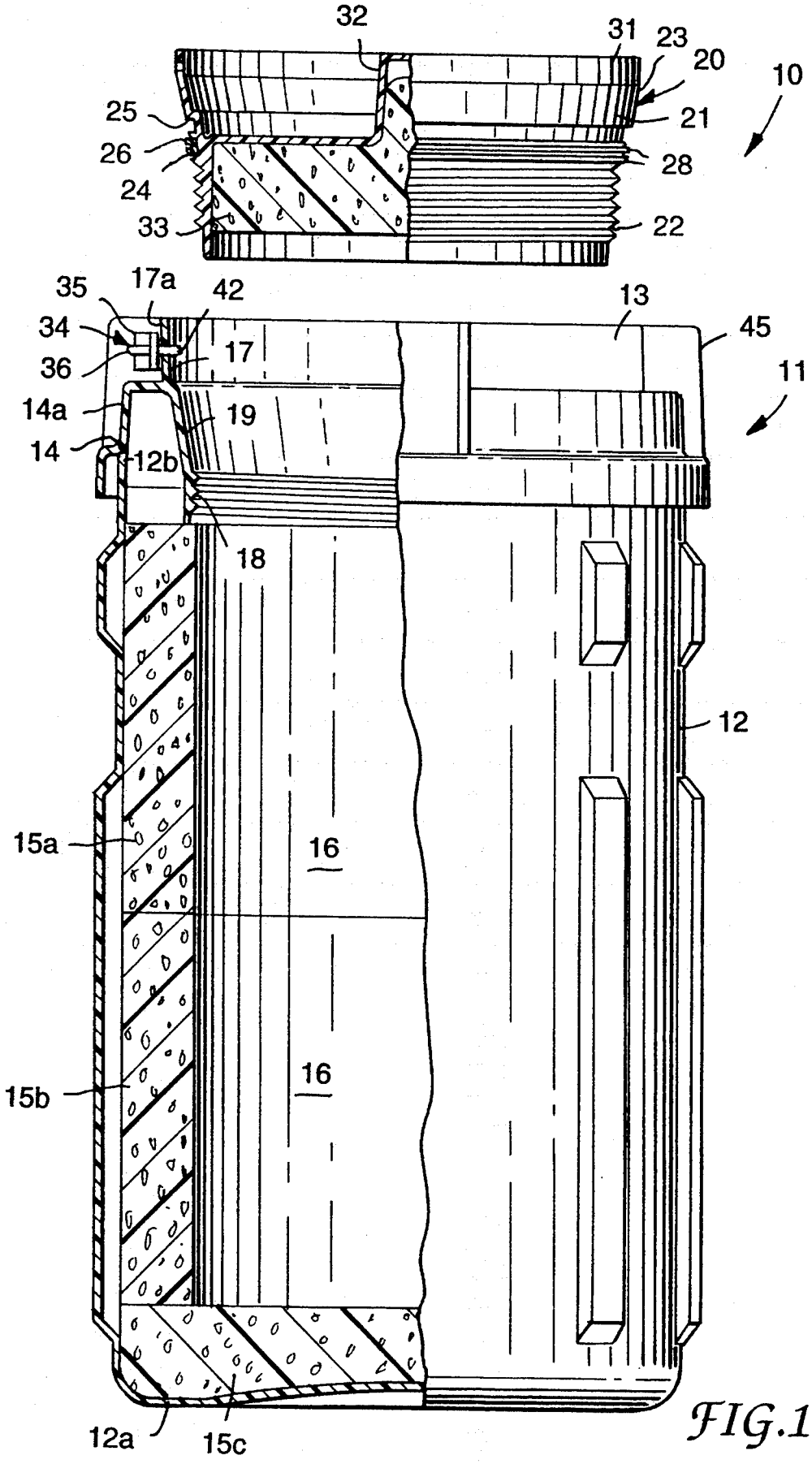
FIG. 1 is an elevational view of a housing and removable cap of a container of the invention, cut away in part to show a cross section of the housing and cap.

Referring to FIG. 1, a container 10 of the invention comprises a self-supporting housing 11, a cap 20, and a manually releasable, self-activating latch 34. The housing 11 comprises a substantially cylindrical base 12 and a collar 13, each being typically formed from a thermoplastic resin and subsequently heat-welded together through a weld 14. The base 12 is closed at one end 12*a* and open at an opposing end 12*b*. The base 12 houses first and second cylindrical sorbent bodies 15*a*, 15*b*, respectively, and a bottom sorbent disc 15*c* which define a central cylindrical pocket 16. Preferably, the cylindrical sorbent bodies 15*a*, 15*b* and the bottom sorbent disc 15*c* comprise compressed polyolefin microfibers such as the compressed polyolefin microfibers described in U.S. Pat. Nos. 5,024,865 (Insley) and 5,029,699 (Insely et al.). A top wall 17 of the collar 13 comprises a threaded portion 18 and a tapered face 19 adjacent the threaded portion 18. The tapered face 19 is coaxial (i.e., has a common central axis) with the threaded portion 18 and is typically generally conical. The collar 13 also includes an outer wall 14*a* which is bonded to the base 12 through the weld 14.

The housing 11 can be closed by the cap 20 which has a wall 21 formed with a threaded portion 22 that is adapted to mate with the threaded portion 18 of the housing 11. Adjacent the threaded portion 22 is a tapered face 23 formed with first and second annular grooves 24, 25 and being coaxial with the threaded portion 22. An elastomeric sealing ring 26 seats in the first annular groove 24 and has two annular lobes 28 which are adapted to be compressed against the tapered face 19 of the collar 13 when the cap 20 is threadably secured to the collar 13, thus forming a liquid-tight seal. The second annular groove 25 is likewise adapted to receive a second elastomeric sealing ring (not shown) if the sealing ring 26 were deemed to be insufficient. The tapered face 23 is typically generally conical and made so that it is closely and substantially uniformly spaced from the tapered face 19 of the collar 13 when the threaded portions 18 and 22 are threadably engaged. Toward the exposed end of the cap 20, the tapered face 23 merges with a cylindrical portion 31 of the cap 20, each of these portions of the cap 20 typically comprising a smooth outer surface. The cylindrical portion 31 of the cap 20 comprises a catch 48. The catch 48 typically takes the form of a hole extending through the cylindrical portion 31 of the wall 21 at a predetermined circumferential location.

Figure 2:
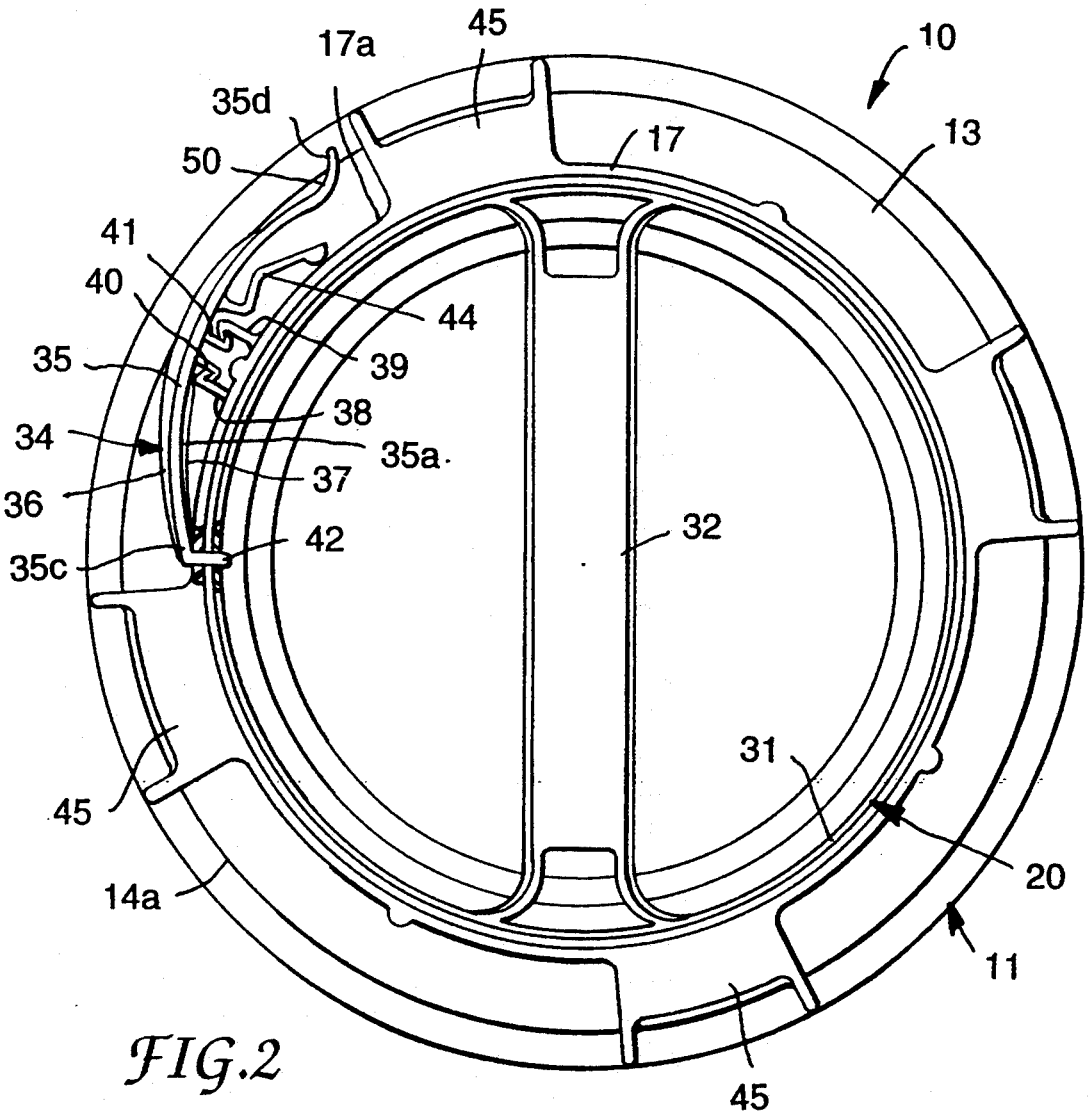
FIG. 2 is a top view of the container of FIG. 1 with its latch locked.
Figure 3:
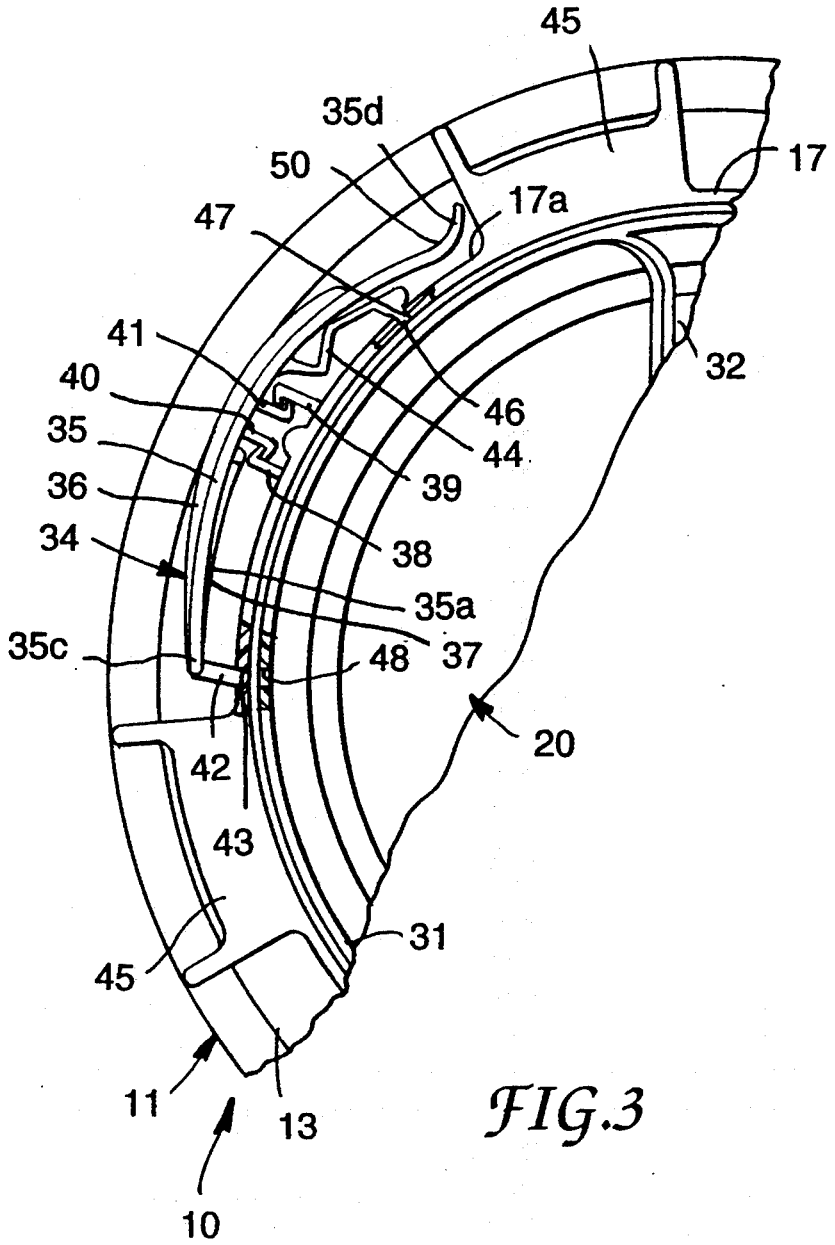
FIG. 3 is a fragmentary enlarged top view partially in cross section and showing the latch in an unlocked position.

Extending across the exposed end of the cap 20 is a handle 32. Microfibers, and preferably the compressed polyolefin microfibers referred to above are securely seated in the cap 20 to provide a fourth sorbent body 33 which can contact a vessel (not shown) containing hazardous materials such as a bottle when the cap 20 is threadably secured to the collar 13 of the housing 11, thus holding the vessel snugly in the central cylindrical pocket 16 and cushioning it against shock during handling and shipment. Referring to FIGS. 2 and 3, the latch 34 is movably mounted on an external surface 17*a* of the top wall 17 of the collar 13. The latch 34 includes an elongated lever 35 made of a single piece of resilient, bendable thermoplastic resin selected from the group consisting of acetal, polyester, and nylon resins. Additionally, stiffening ribs 36, 37 are formed on the lever 35 to strengthen the lever 35 and make it substantially rigid during use.

Figure 4:
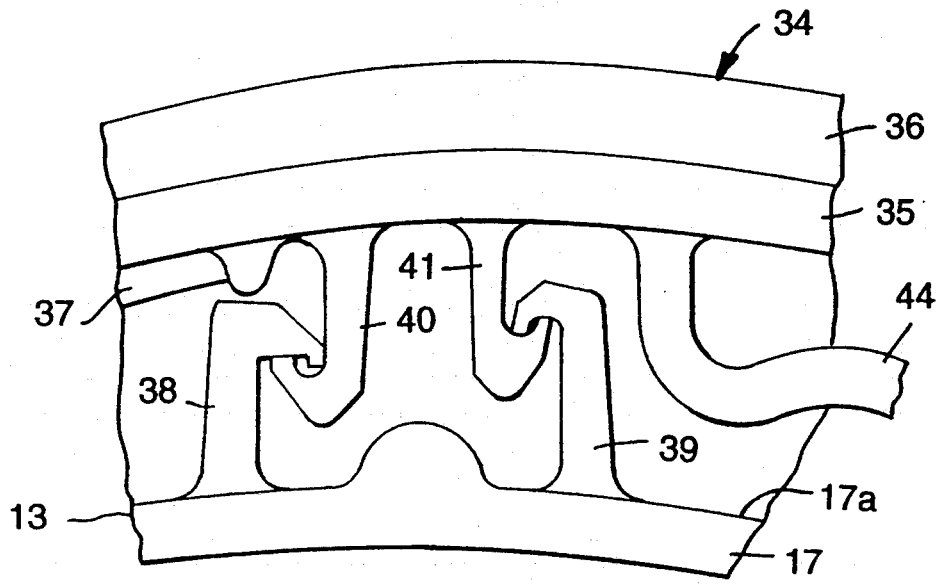
FIG. 4. shows an enlarged fragment of the top view of FIG. 2 showing the manner of attachment of the latch to the housing and the position of the latch relative to the housing when the latch is in the locked position.

Referring to FIG. 4, the latch 34 is movably mounted on the external surface 17*a* of the top wall 17 of the collar 13. Projecting outwardly from the external surface 17*a* of the top wall 17 at a position between two of four stiffening ribs 45 (see FIG. 2) are first and third hook-shaped members 38, 39, respectively, which are adapted for interlocking engagement with second and fourth hook-shaped members 40, 41, respectively, that project from a generally central axial location of an internal surface 35*a* of the lever 35.

Referring to FIG. 3, a locking member 42 preferably taking the form of a pin projects from the internal surface 35*a* of the lever 35 at a first end 35*c* of the lever 35 and protrudes through a bore 43 that extends through the top wall 17 of the collar 13. Cantilevered from the lever 35 is a relatively flexible, serpentine tongue 44 which is made of the same material as the lever 35 but acts as a spring to bias the locking member 42 through the bore 43 while forcing the second hook-shaped member 40 outwardly against the first hook-shaped member 38 to provide a fulcrum for the latch 34. At the free end of the tongue 44 is a stud 46 that anchors the latch 34 by snugly fitting into a recess 47 in the external surface 17*a* of the top wall 17 of the collar 13.

The construction of a container of the invention necessitates providing the catch 48 at the appropriate location on the collar 13 of the housing 11. To accomplish this, before the latch 34 is mounted on the collar 13, the cap 20 is screwed into the collar 13 while the torque is being measured. When the torque reaches a predetermined level indicating the cap 20 is sufficiently screwed into the open end of the housing 11, the catch 48 is typically provided by drilling a hole into the cap 20 in alignment with the bore 43 of the collar 13. The bore 43 can be formed substantially simultaneously as the catch 48 or before formation of the catch 48. In other words, the bore 43 and the catch 48 can be formed in separate steps. The latch 34 can then be mounted on the collar 13 so that the locking member 42 protrudes through the bore 43.

Referring to FIG. 1, when it is desired to close the open end of the housing 11, the cap 20 is placed over the open end and rotated clockwise so that the threaded portions 22, 18 of the cap 20 and the collar 13, respectively, mate. As the cap 20 is inserted into the open end of the housing and rotated in clockwise fashion, the locking member 42 of the latch 34 contacts and "rides on" the smooth outer surfaces of the tapered face 23 and the cylindrical portion 31 of the cap 20 as the cap is being threadably secured to the collar 13. When the torque reaches the predetermined level, the locking member 42 automatically drops into the catch 48 in the cap 20, creating a snapping noise that provides an audible indication that the cap 20 is locked to the housing 11.

Referring to FIG. 3, once the cap 20 is locked to the housing 11, the cap 20 cannot be further threaded or unthreaded without manually depressing an upturned finger rest 50 at a second end **35*d* (the free end) of the lever 35 to lift the locking member 42 out of engagement with the catch 48. When the upturned finger rest 50 of the lever 35 is depressed, the third and fourth hook-shaped members 39, 41, respectively, typically become disengaged and the lever 35 pivots about the fulcrum formed by the first and second hook-shaped members 38, 40, respectively. As shown in FIGS. 2 and 4, when the latch 34 is in its locked position, the third and fourth hook-shaped members 39, 41, respectively, are in engagement to ensure that the latch 34 remains suitably positioned on the collar 13**.

Figure 5:
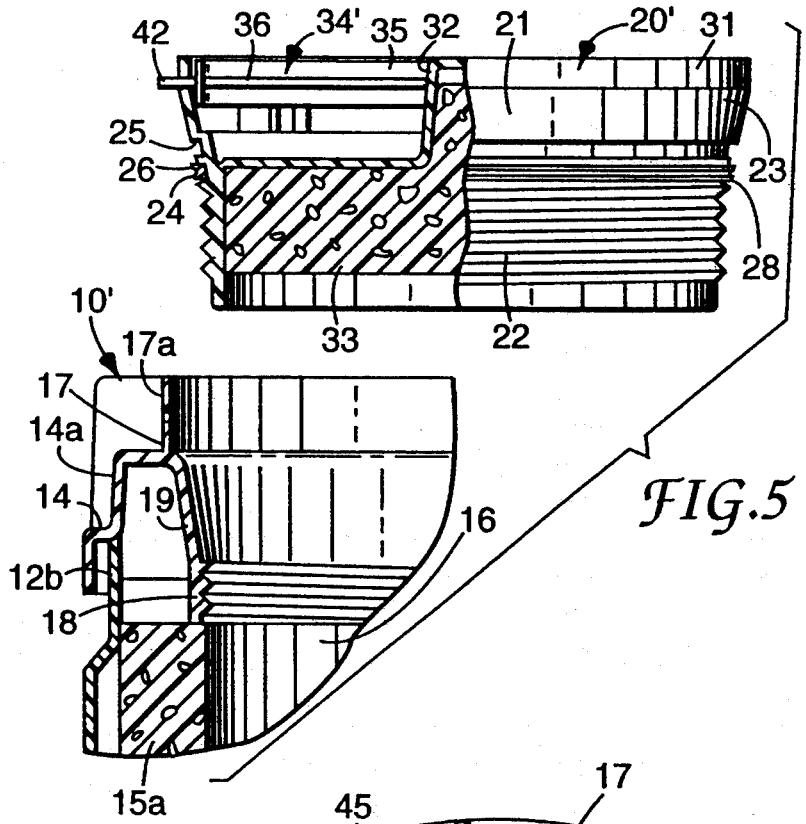
FIG. 5 is a fragmentary elevational view of a housing and removable cap of a container of the invention, cut away in part to show a cross section of the housing and cap.
Figure 6:
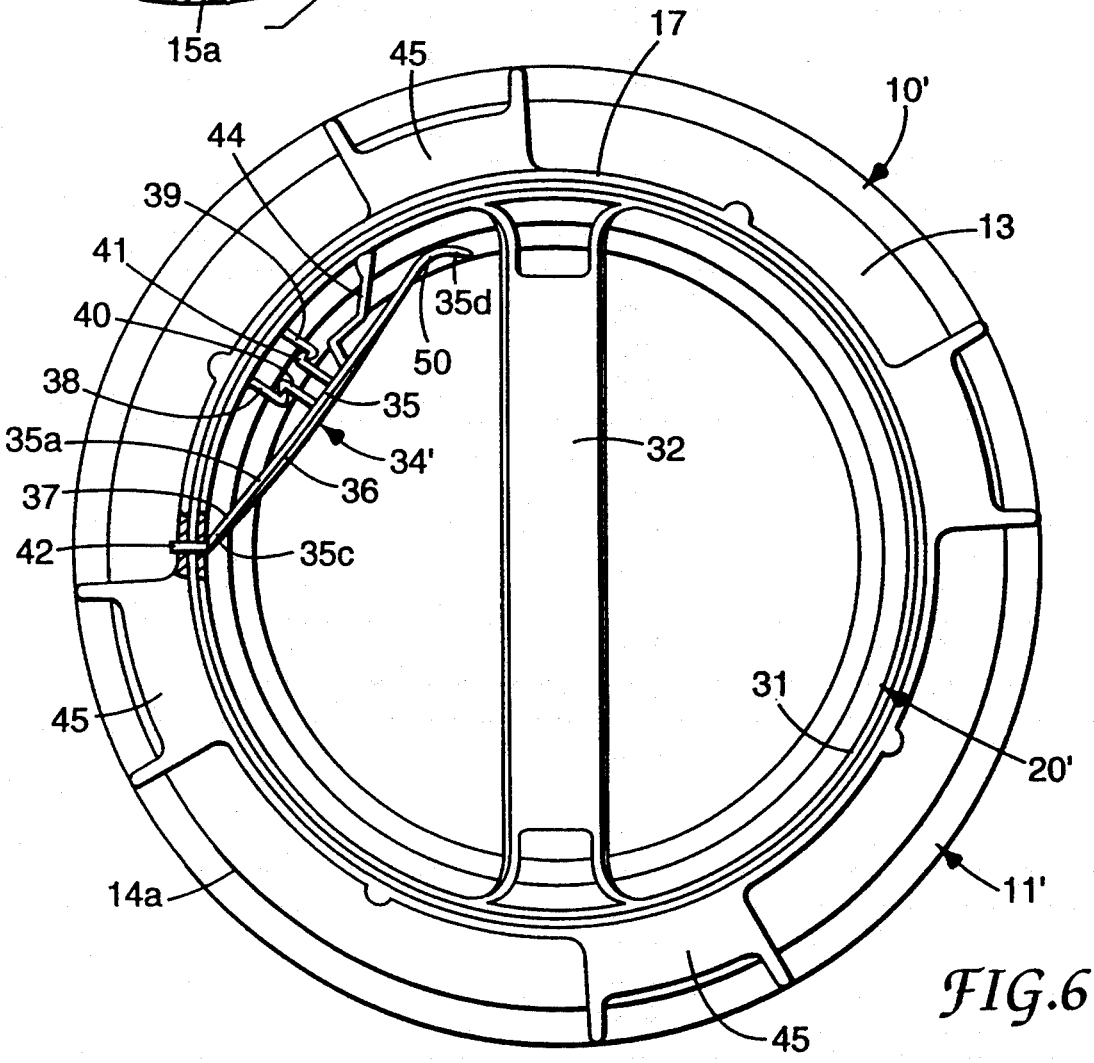
FIG. 6 is a top view of the container of FIG. 5 with its latch locked.
Figure 7:
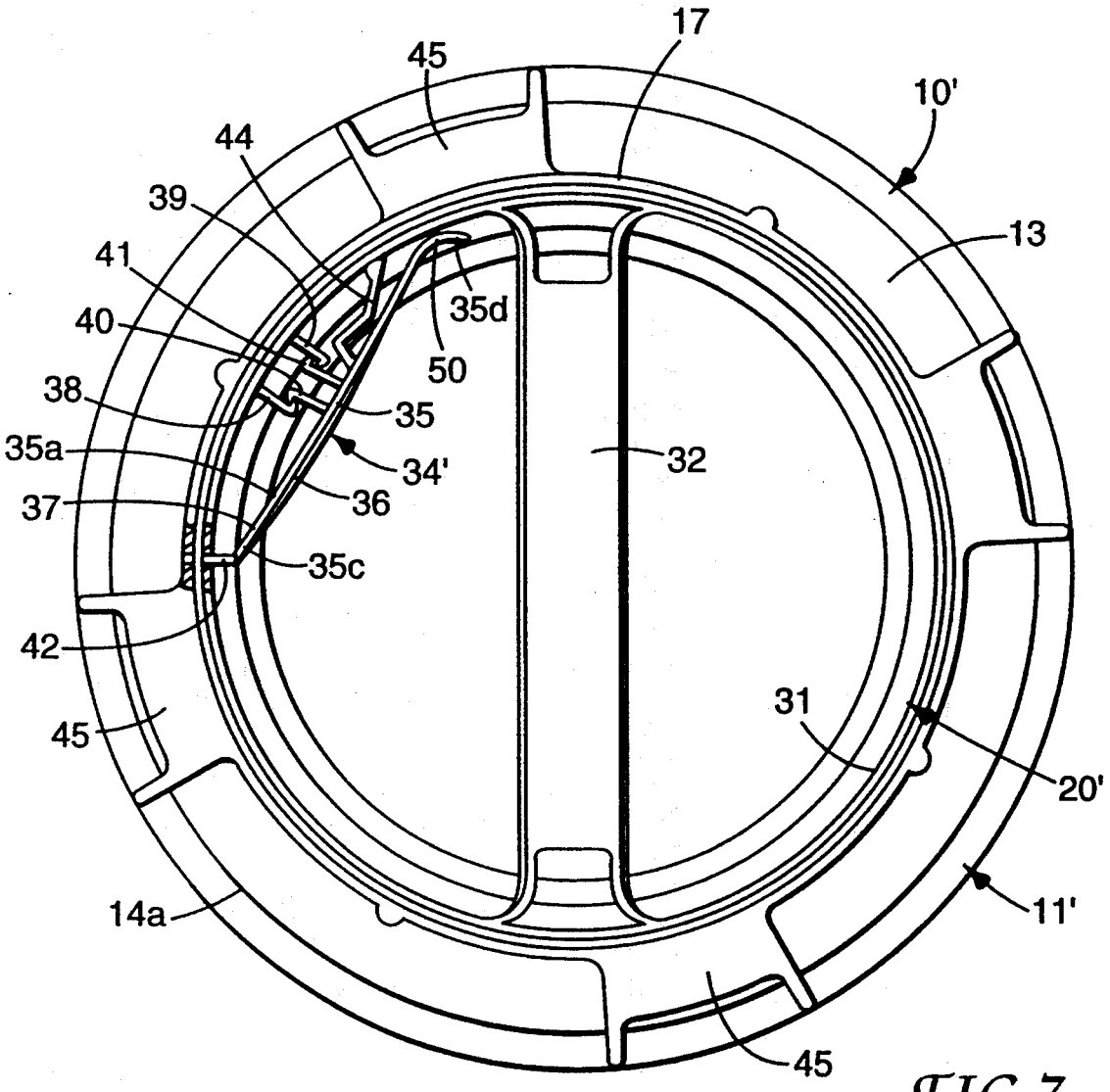
FIG. 7 is a fragmentary enlarged top view partially in cross section and showing the latch in an unlocked position.

In FIGS. 5, 6 and 7, an alternative embodiment is shown where like parts are similarly numbered. In this embodiment, the latch and hook-shaped members are located on the inner surface of the cylindrical portion 31 of wall 21 of cap 20 such that locking member 42 is biased against cylindrical portion 31 in the unlocked position (FIG. 7) and engages bore 43 in the locked position (FIG. 6).

Referring to FIG. 1, in addition to storing and shipping vessels containing hazardous liquids, containers of the invention can be put to a variety of other uses. For example, the housing 11 can constitute the filler tube of an automotive fuel tank from which the cap 20 can be easily unscrewed. A good seal provided by the cap 20 can prevent fuel vapors from escaping into the atmosphere when the cap 20 is threadably secured to the housing 11. Containers of the invention can also be utilized as insulated bottles for maintaining the temperature of a food or drink and to reduce the likelihood of spillage as a result of inadvertent loosening of the bottle cap. Containers of the invention also may be useful in child-proof packaging of medicines and other potentially hazardous materials.

Preferably, the seal achieved between the cap 20 and the collar 13 of the housing 11 upon appropriate tightening of the cap 20 will be sufficient to permit the container to satisfy the requirements of Paragraph 9.3.4.1 of the "United Nations Recommendations on the Transport of Dangerous Goods" (hereinafter "UNRTDG"), and Part 3:1.1.6.1 of the "International Civil Aviation Organization Technical Instructions on the Safe Transport of Dangerous Goods by Air Container" (hereinafter "ICAO").

Preferably, the housing 11 and the cap 20 are made from a high impact, chemically resistant, thermoplastic resin such as polyethylene or other polyolefin and formed as single pieces in a mold.

EXAMPLE

A container as illustrated in FIGS. 1–4 was prepared using standard blow molding techniques to prepare the base 12 and standard injection molding techniques to prepare the collar 13 and the cap 20, each of these parts being made from a high density polyethylene resin sold under the trade designation 08354N by Dow Chemical Co. of Midland, Mich. Key dimensions and features of the component parts of the container included the following:

The base 12 had a wall thickness of 2.3 mm, an outer diameter of 18.4 cm, and a height of 27.3 cm.

The collar 13 had a wall thickness of 2.3 mm, the threaded portion 18 of the collar had a 12.58 cm pitch diameter with 2.36 threads/cm, the tapered face 19 immediately above the threaded portion 18 sloped outwardly at a 10° angle from the vertical, and the outer wall **14*a* had a diameter of 18.4 cm. The first and third hook-shaped members 38, 39, respectively, were formed between two of the four stiffening ribs 45**, the hook-shaped members being spaced approximately 10 mm apart, each member having a width of 1.73 mm, a length of 5.69 mm and an inwardly projecting hook component With a barb of approximately 2 mm.

The cap 20 had a wall thickness of 2.3 mm, the threaded portion 22 thereof had a 12.45 cm pitch diameter and 2.36 threads/cm, and the first and second annular grooves 24, 25, respectively, were both approximately 4.8 mm wide.

The cylindrical sorbent bodies **15*a*, 15*b* and the bottom sorbent disc 15*c* were made as described in U.S. Pat. No. 5,029,699 (Insley et al.), which is incorporated in its entirety herein by reference. The disc 15*c*, having a thickness of approximately 3.1 cm, was formed in the base 12 by compressing polyolefin microfibers in the bottom of the base 12 to a solidity of approximately 35%. The cylindrical sorbent bodies 15*a*, 15*b* were formed as two identical cylinders, each approximately 11 cm in height and having a wall thickness of approximately 2.1 cm and a solidity of approximately 35%. The two cylindrical sorbent bodies 15*a*, 15*b* were subsequently inserted into the base 12 and brought into intimate contact with each other. The second cylindrical sorbent body 15*b* was brought into intimate contact with the bottom sorbent disc 15*c***.

The outer wall **14*a* of the collar 13 was then aligned with the cylindrical sidewalls of the base 12 and the two components joined along the weld 14** to create a hermetic, fluid-tight seal. The seal was formed by heating the mating surfaces of the component parts on a hot plate to soften the polyethylene resin sufficiently so that when the parts were mated they formed a hermetic seal. Alternative heating means such as hot air, induction heating, or electromagnetic heating could also have been utilized for this purpose.

The fourth sorbent body 33 of the cap 20 was formed by placing the cap 20 in a supporting cradle conformed to match the contour of the inverted cap and compressing polyolefin microfibers in the cap to a solidity of approximately 35%. A 12.4 cm diameter by 3.18 mm axial thickness Teflon coated elastomeric ethylene/propylene quad lobe sealing ring sold under the trade designation Quad Ring TM by Minnesota Rubber Company of Minneapolis, Minn. was then placed in the first annular groove 24 to complete the assembly of the cap.

The latch 34 was formed in a conventionally designed mold by standard injection molding techniques from an acetal copolymer resin having a 3% glass filler, the resin being sold under the trade designation CELCON TM M 90 by Hoechst Celanese Corp. of Somerville, N.J. The lever 35 of the latch 34 was molded substantially as an arc of a cylinder of 5.65 cm diameter, was 8.16 cm in length, 1.33 cm in width, and had a maximum thickness of 0.2 cm across the ribs 36, 37. The locking member 42 took the form of a pin and had a diameter of 3.17 mm and a length of 5.7 mm. The stiffening ribs 36, 37 were approximately 5 cm and 2.85 cm, respectively, in length.

The serpentine tongue 44 of the latch 34 extended from the internal surface 35*a* of the lever 35 at a point approximately 3.93 mm from the fourth hook-shaped member 41, was 5.0 mm in width, 2.0 mm thick, and approximately 2.54 cm in length. The stud 46 had a diameter of 3.17 mm and a length of 2.03 mm. The second and fourth hook-shaped members 40, 41, respectively, extended from the lever 35 approximately 3 mm apart from each other with the members 40, 41 both being approximately 9.35 mm wide, 1.27 mm thick, 5.86 mm long, and having an outwardly projecting hook component with a barb of approximately 1.65 mm.

The bore 43 and the recess 47 (both 3.96 mm in diameter) were drilled in the top wall 17 of the collar 13, as indicated in FIG. 3, to coincide with the locking member 42 and the stud 46, respectively. The assembled cap 20 was then threaded into the collar 13 to a torque of 5.1 joules (45 inch pounds), and a 3.96 mm diameter hole was drilled through the cylindrical portion 31 of the cap 20 and in register with the bore 43, the hole constituting the catch 48. The latch 34 was then installed with the hook-shaped members 38, 39 engaging the hook-shaped members 40, 41, respectively, and the locking member 42 protruding through the bore 43 and the catch 48, and the stud 46 seating in the recess 47. The cap 20 was then unscrewed by depressing the finger rest 50 of the latch 34 to lift the locking member 42 out of the catch 48.

Pressure Testing

Integrity of the container seal was determined by the following hydraulic pressure test:

The container 10 made as described above was closed to the specified latch position and inverted on a 20 cm by 20 cm piece of blotter paper. Two pressure fittings were then tapped into the bottom of the inverted container, and the unit was filled with tap water through one of the fittings and air was vented from the second fitting. Precautions were taken to ensure that no entrained air was retained in the sorbent bodies of the container after filling. Subsequent to filling the container with water, one of the fittings was attached to a pressure gauge, and the second fitting was attached to a gas pressure line which was used to pressurize the container to 100 kPa. The pressurized container was monitored for leakage onto the blotter paper for a test period of 30 minutes.

The container met the requirements of Paragraph 9.3.4.1 of the UNRTDG and Part 3:1.1.6.1 of the ICAO by showing no liquid leak over the test period.

Drop Testing

A primary container (a one liter round boston glass bottle filled with a 30 volume percent ethylene glycol/-water solution and sealed with a phenolic cap) was placed in a secondary container (the container 10 made as described above, which was subsequently closed to the specified latch position), and the container combination was conditioned at −18° C. for 24 hours. The cold container combination was then dropped onto a concrete surface from a height of 6.1 meters such that it impacted on its top, bottom and side. No failures of the primary or secondary container were observed, meaning that the secondary container 10 met the requirements of Paragraph 9.7.3 of the UNRTDG for a one-liter capacity super pack adapted to carry primary containers filled with fluids of specific gravity of 2.0 or less.

Sorbent Capacity

Absorbent capacity of the container 10 made as described above was determined by saturating the sorbent components in a step-wise procedure. An initial volume (500 mL) of water was placed in the container 10, and the container was closed and vigorously shaken for one minute. This same sequence was continuously repeated by adding additional quantities of water until excess water remained in the bottom of the container. The cumulative absorbent capacity for the container was determined to be 1800 mL, a safety factor of 1.8 times the limit prescribed in Paragraph 9.3.2 of the UNRTDG and the ICAO Part 5.0.16 requirements for a one-liter capacity super pack.

What is claimed is:

1. A container comprising:

a) a housing;

b) a removable cap;

c) a first wall on one of the housing and cap, the first wall comprising a first threaded portion and having a tapered face that is coaxial with the first threaded portion;

d) a second wall on the other of the housing and cap, the second wall comprising a second threaded portion that is adapted to mate with the first threaded portion;

e) a catch formed on the second wall;

f) a bore formed through the first wall;

g) a manually releasable, self-activating latch mounted on the first wall, the latch comprising an elongated lever, the lever comprising a locking member which is adapted to protrude through the bore and slide along the second wall when the first and second threaded portions are being threadably secured together, wherein the latch and the catch are positioned on their respective walls such that the locking member is adapted to engage the catch to prevent relative movement between the first and second threaded portions only when a predetermined torque is applied to the first and second threaded portions; and h) a sealing ring mounted on the second wall which is adapted to be compressed against the tapered face of the first wall when the first and second threaded portions are threadably secured together.

2. The container of claim 1 wherein the second wall has a tapered face that is adapted to be closely and substantially uniformly spaced from the tapered face of the first wall when the first and second threaded portions are threadably engaged.

3. The container of claim 1 wherein the housing comprises a substantially cylindrical base and a collar comprising one of the first and second walls.

4. The container of claim 3 wherein the base, the collar, and the cap comprise a thermoplastic resin.

5. The container of claim 4 wherein the thermoplastic resin is selected from the group consisting of acetal, polyester, and nylon resins.

6. The container of claim 1 wherein the elongated lever comprises a single piece of thermoplastic resin.

7. The container of claim 1 wherein the housing comprises the first wall and the cap comprises the second wall.

8. The container of claim 7 wherein the locking member projects from a first end of the lever and a relatively flexible, serpentine tongue is cantilevered from the lever and is adapted to act as a spring member to bias the locking member against the second wall while the threaded portions are being threadably secured.

9. The container of claim 8 wherein the cantilevered tongue terminates in a stud, and the first wall comprises a recess for anchoring the stud to the first wall.

10. The container of claim 8 wherein first and second interlocking hook-shaped members project from the first wall and from a central location of the lever, respectively, and cooperate to define a fulcrum for the latch.

11. The container of claim 10, further comprising interlocking third and fourth hook-shaped members that project from the first wall and from the central location of the lever, respectively.

12. The container of claim 1 wherein the catch is a hole into which the locking member can fit.

* * * * *

UNITED STATES PATENT AND TRADEMARK OFFICE

CERTIFICATE OF CORRECTION

PATENT NO. : 5,437,387

DATED : August 1, 1995

INVENTOR(S) : James A. Burns

It is certified that error appears in the above-indentified patent and that said Letters Patent is hereby corrected as shown below:

The title page, showing an illustrative figure, should be deleted and substitute therefor the attached title page.

Delete the drawing sheet consisting of Figure 4, and replaced with Figure 4, as shown on the attached pages.

United States Patent [19]

Burns

[11] Patent Number: 5,437,387

[45] Date of Patent: Aug. 1, 1995

[54] CONTAINER WITH SCREW-ON CAP HAVING A CONTROLLED-TORQUE LATCH

[75] Inventor: James A. Burns, Lake Elmo, Minn.

[73] Assignee: Minnesota Mining and Manufacturing Company, St. Paul, Minn.

[21] Appl. No.: 4,946

[22] Filed: Jan. 15, 1993

[51] Int. Cl.[6] ..... B65D 45/16

[52] U.S. Cl. ..... 220/326; 220/324; 220/281; 220/288; 215/213; 215/216; 215/221; 215/356

[58] Field of Search ..... 215/213, 214, 216, 221, 215/356; 220/324, 326, 281, 288

[56] References Cited

U.S. PATENT DOCUMENTS

| | | | |
|---|---|---|---|
| 3,365,088 | 1/1968 | Turner | 215/9 |
| 3,376,992 | 4/1968 | Klapp, Sr. | 215/221 |
| 3,447,709 | 6/1969 | Marasco | 215/221 |
| 3,582,535 | 6/1971 | Appleton | 220/288 X |
| 3,743,127 | 7/1973 | Morceau | 215/221 |
| 3,935,963 | 2/1976 | Knize | 215/221 X |
| 4,037,747 | 7/1977 | Acton et al. | 215/219 |
| 4,103,797 | 8/1978 | Morris | 215/209 |
| 4,207,982 | 6/1980 | Maxwell et al. | 215/230 X |
| 4,331,247 | 5/1982 | Mumford | 215/216 |
| 4,690,292 | 9/1987 | Henning | 215/201 |
| 4,732,288 | 3/1988 | Morris, Sr. | 215/214 |
| 4,752,014 | 6/1988 | House et al. | 215/216 |
| 4,967,926 | 11/1990 | Morris, Sr. | 220/323 |
| 5,024,865 | 6/1991 | Insley | 428/36.4 |
| 5,029,699 | 7/1991 | Insley et al. | 206/204 |
| 5,096,083 | 3/1992 | Shaw et al. | 220/304 |
| 5,125,538 | 6/1992 | Morris, Sr. | 215/329 X |

*Primary Examiner*—Gary E. Elkins
*Assistant Examiner*—Vanessa Caretto
*Attorney, Agent, or Firm*—Gary L. Griswold; Walter N. Kirn; Carole Truesdale

[57] ABSTRACT

A container for transporting and storing vessels containing hazardous liquids and a method for making such a container. The container has a cylindrical housing and a cap that screws into the mouth of the housing and is locked by a latch. When the cap is screwed into place, an elastomeric sealing ring on the cap is compressed against the housing to provide a liquid-tight seal between the housing and cap. Interlocking hook-shaped members that project from the housing and from a central location of the latch act as a fulcrum on which the latch can be pivoted. Under the bias of a serpentine tongue, a locking member that projects from an end of the latch protrudes through a bore in the housing and is adapted to be received by a hole in the cap, thus locking the cap until the other end of the lever is depressed to disengage the locking member from the hole of the cap. The hole in the cap is drilled at a position such that the locking member fits into the hole when the cap has been sufficiently screwed into the housing to provide a liquid-tight seal between the cap and housing, yet not so tight as to damage the threaded portions or make it unduly difficult to unscrew the cap.

12 Claims, 5 Drawing Sheets

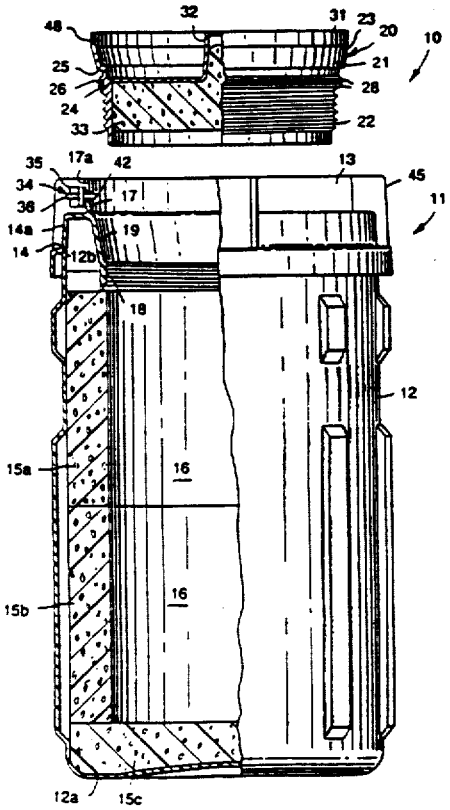

UNITED STATES PATENT AND TRADEMARK OFFICE

CERTIFICATE OF CORRECTION

PATENT NO. : 5,437,387

DATED : August 1, 1995

INVENTOR(S) : James A. Burns

It is certified that error appears in the above-indentified patent and that said Letters Patent is hereby corrected as shown below:

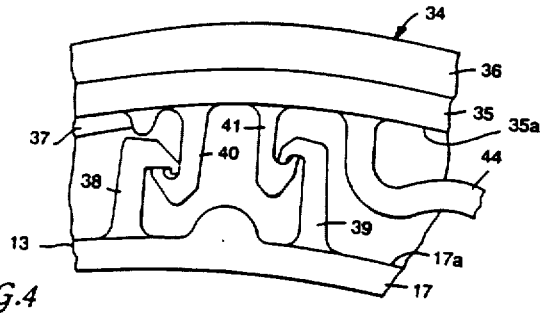

FIG.4

Signed and Sealed this

Fifth Day of December, 1995

Bruce Lehman

BRUCE LEHMAN

*Commissioner of Patents and Trademarks*

*Attest:*

*Attesting Officer*